US009417022B2

(12) United States Patent
Sherrill

(10) Patent No.: US 9,417,022 B2
(45) Date of Patent: Aug. 16, 2016

(54) COMBINATION FLASH HIDER AND MUZZLE BRAKE

(71) Applicant: John William Sherrill, Lubbock, TX (US)

(72) Inventor: John William Sherrill, Lubbock, TX (US)

( * ) Notice: Subject to any disclaimer, the term of this patent is extended or adjusted under 35 U.S.C. 154(b) by 16 days.

(21) Appl. No.: 14/331,737

(22) Filed: Jul. 15, 2014

(65) Prior Publication Data

US 2015/0308774 A1 Oct. 29, 2015

Related U.S. Application Data

(60) Provisional application No. 61/901,164, filed on Nov. 7, 2013.

(51) Int. Cl.
*F41A 21/00* (2006.01)
*F41A 21/34* (2006.01)
*F41A 21/36* (2006.01)

(52) U.S. Cl.
CPC ..... *F41A 21/34* (2013.01); *F41A 21/36* (2013.01)

(58) Field of Classification Search
CPC ..... F41A 21/34; F41A 21/36; F41A 21/30
USPC ..... 89/14.2, 14.3; 181/223
See application file for complete search history.

(56) References Cited

U.S. PATENT DOCUMENTS

| | | | | | |
|---|---|---|---|---|---|
| 1,415,919 | A * | 5/1922 | Butler | F41A 21/34 | 89/14.2 |
| 1,427,802 | A * | 9/1922 | Goodwin | F41A 21/30 | 181/223 |
| 2,883,781 | A * | 4/1959 | Harvey | F41A 21/34 | 42/105 |
| 3,164,060 | A * | 1/1965 | Dahl | F41A 21/30 | 89/14.2 |
| 3,677,132 | A * | 7/1972 | Plenge | F41A 21/30 | 42/1.14 |
| 3,710,683 | A * | 1/1973 | Kaltmann | F41A 21/36 | 89/14.2 |
| 3,714,864 | A * | 2/1973 | Thierry | F41A 21/38 | 89/14.3 |
| 4,576,083 | A * | 3/1986 | Seberger, Jr. | F01N 1/08 | 181/223 |
| D285,238 | S * | 8/1986 | Cellini | 89/14.3 | |
| 4,893,544 | A * | 1/1990 | Hawley | F41A 21/34 | 89/14.2 |
| 4,907,488 | A * | 3/1990 | Seberger | F41A 21/30 | 181/223 |

(Continued)

OTHER PUBLICATIONS

Boatright, James, Rifle Recoil Studies (www.thewellguidedbullet.com/pdfs/riflerecoilstudies.pdf) Copyright 2009.*

*Primary Examiner* — Michelle R Clement
(74) *Attorney, Agent, or Firm* — Braxton, Hilton & Perrone, PLLC

(57) ABSTRACT

A system and method for a combination flash hider and muzzle brake. The flash hider is upstream of the muzzle brake. This allows the flash hider to take priority over the muzzle brake. The flash hider has slots allowing the exhausting gas to exit, causing the exhaust gases to decrease temperature and pressure to a point below the flash point. This reduces flash. The muzzle brake has at least one port.

17 Claims, 5 Drawing Sheets

(56) References Cited

U.S. PATENT DOCUMENTS 4,967,642 A * 11/1990 Mihaita ..... F41A 3/72 89/126
5,136,923 A * 8/1992 Walsh, Jr. ..... F41A 21/30 89/14.2
5,303,634 A * 4/1994 Warner ..... F41A 21/34 89/14.2
5,361,677 A * 11/1994 Warner ..... F41A 21/34 89/14.2
5,385,079 A * 1/1995 Cave ..... F41A 21/36 89/14.3
5,476,028 A * 12/1995 Seberger ..... F41A 21/36 89/14.3
5,596,161 A * 1/1997 Sommers ..... F41A 21/34 89/14.2
5,631,438 A * 5/1997 Martel ..... F41A 21/36 42/72
5,798,474 A * 8/1998 Rogers ..... F41A 21/36 42/76.01
6,269,727 B1 * 8/2001 Nigge ..... F41A 21/36 89/14.3
6,298,764 B1 * 10/2001 Sherman ..... F41A 21/34 89/14.2
6,595,099 B1 * 7/2003 Olson ..... F41A 21/34 89/14.2
6,722,254 B1 * 4/2004 Davies ..... F41A 21/36 42/1.06
6,923,292 B2 * 8/2005 Woods ..... F41A 21/34 181/223
7,207,255 B2 * 4/2007 Felton ..... F41A 21/36 89/14.3
7,870,815 B2 * 1/2011 Hung ..... F41A 21/34 42/77
8,042,448 B1 * 10/2011 Sylvester ..... F41A 21/34 42/1.06
8,104,394 B2 * 1/2012 Meyers ..... F41A 21/34 42/77
8,205,538 B2 * 6/2012 Dueck ..... F41A 21/36 89/14.3
8,272,306 B1 * 9/2012 Smith ..... F41A 21/30 181/223
8,418,803 B2 * 4/2013 Findlay ..... F41A 21/30 181/223
D692,086 S * 10/2013 Nierenberg ..... D22/108
D694,355 S * 11/2013 Hormann ..... D22/108
8,695,474 B2 * 4/2014 Overbeek Bloem .. F41A 21/325 89/14.2
8,739,674 B1 * 6/2014 Huber ..... F41A 21/32 89/14.2
8,769,852 B2 * 7/2014 Coleman ..... F41A 21/34 42/1.06
8,770,084 B2 * 7/2014 Young ..... F41A 21/30 181/223
D716,904 S * 11/2014 Oglesby ..... D22/108
8,973,481 B2 * 3/2015 Dueck ..... F41A 21/325 181/223
D737,922 S * 9/2015 Pace ..... D22/108
2002/0112602 A1 * 8/2002 Champion ..... F41A 21/36 89/14.3
2003/0106416 A1 * 6/2003 Vais ..... F41A 21/36 89/14.3
2003/0106417 A1 * 6/2003 Vais ..... F41A 21/36 89/14.3
2006/0048639 A1 * 3/2006 Felton ..... F41A 21/36 89/14.3
2009/0178549 A1 * 7/2009 Meyers ..... F41A 21/34 89/14.2
2010/0229712 A1 * 9/2010 Graham ..... F41A 21/34 89/14.2
2010/0282056 A1 * 11/2010 Hung ..... F41A 21/34 89/14.2
2011/0271575 A1 * 11/2011 Overbeek Bloem .. F41A 21/325 42/90
2012/0048100 A1 * 3/2012 Davies ..... F41A 21/34 89/14.2
2012/0152649 A1 * 6/2012 Larue ..... F41A 21/30 181/223
2012/0180352 A1 * 7/2012 Addis ..... F41A 21/32 42/1.06
2012/0228052 A1 * 9/2012 Findlay ..... F41A 21/30 181/223
2012/0279798 A1 * 11/2012 Kline ..... F41A 21/30 181/223
2013/0233162 A1 * 9/2013 Schneider ..... F41A 13/12 89/14.3
2013/0340313 A1 * 12/2013 Myers ..... F41A 21/30 42/90

* cited by examiner

COMBINATION FLASH HIDER AND MUZZLE BRAKE

PRIORITY

This application claims priority to U.S. 61/901,164 filed Nov. 7, 2013, the entirety of which is incorporated herein by reference.

BACKGROUND OF THE INVENTION

1. Technical Field

The present invention relates to a system and method for a combination flash hider and muzzle brake.

2. Description of Related Art

Flash hiders and muzzle brakes are used in the art to give the user a tactical advantage. A flash hider reduces the flash after firing whereas a muzzle brake reduces recoil. However, there is not a device known in the prior art which satisfactorily combines a muzzle brake with a flash hider. Consequently, there is a need in the art for a combination muzzle brake and flash hider.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DETAILED DESCRIPTION

Several embodiments of Applicant's invention will now be described with reference to the drawings. Unless otherwise noted, like elements will be identified by identical numbers throughout all figures. The invention illustratively disclosed herein suitably may be practiced in the absence of any element which is not specifically disclosed herein.

In one embodiment, the device is used to address both reduction in recoil and flash. The prior art fails to perform in a way that addresses flash suppression first, and then recoil reduction. The addition of the recoil reducing ports on the front of the flash hider also eliminates open prong flash hider snagging, ringing, and breakage of individual prongs. This device results in an enhancement to current capability in durability, stealth, and weapons control.

Figure 1:
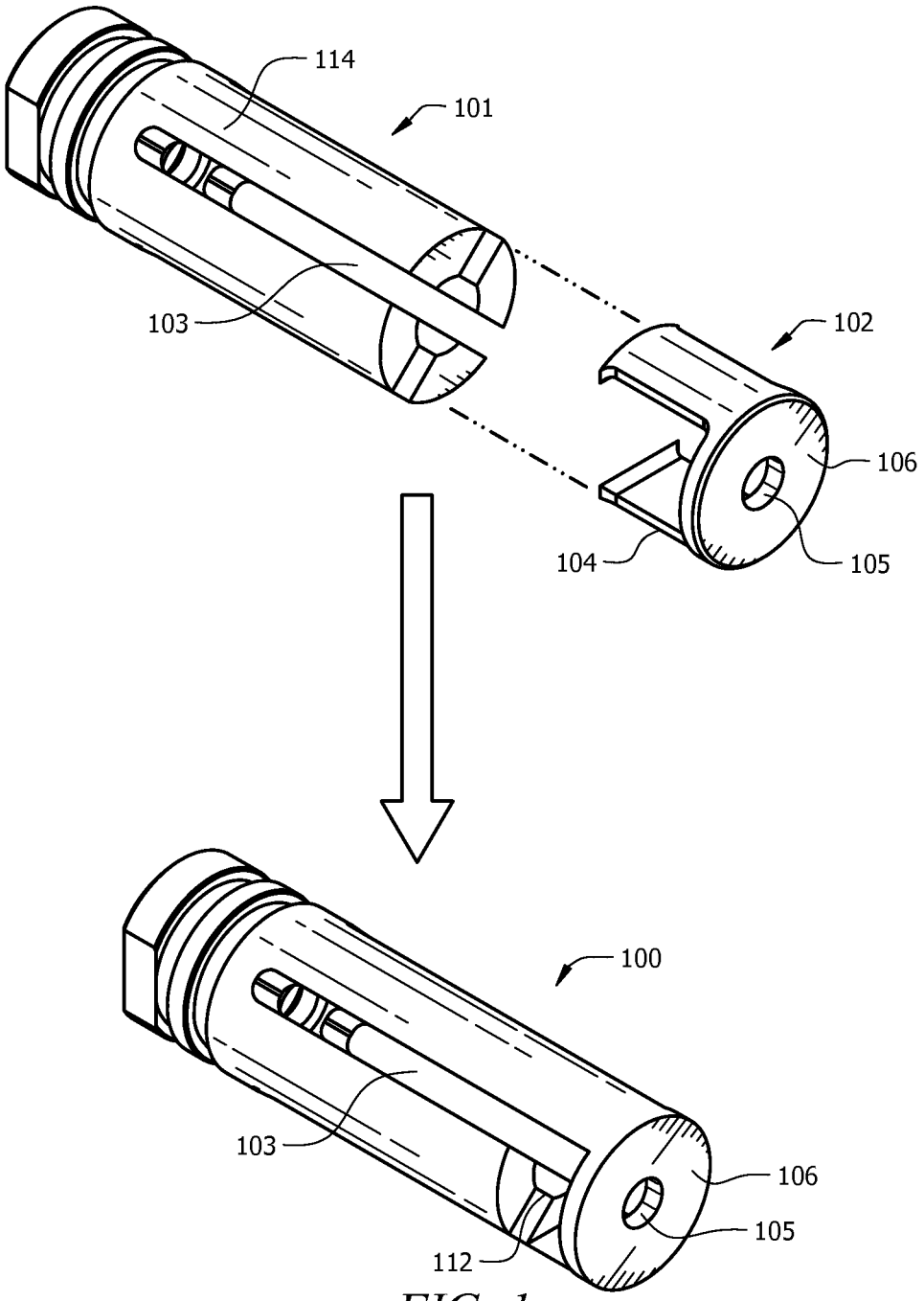
FIG. 1 is a perspective view of an exploded device in one embodiment.
Figure 2:
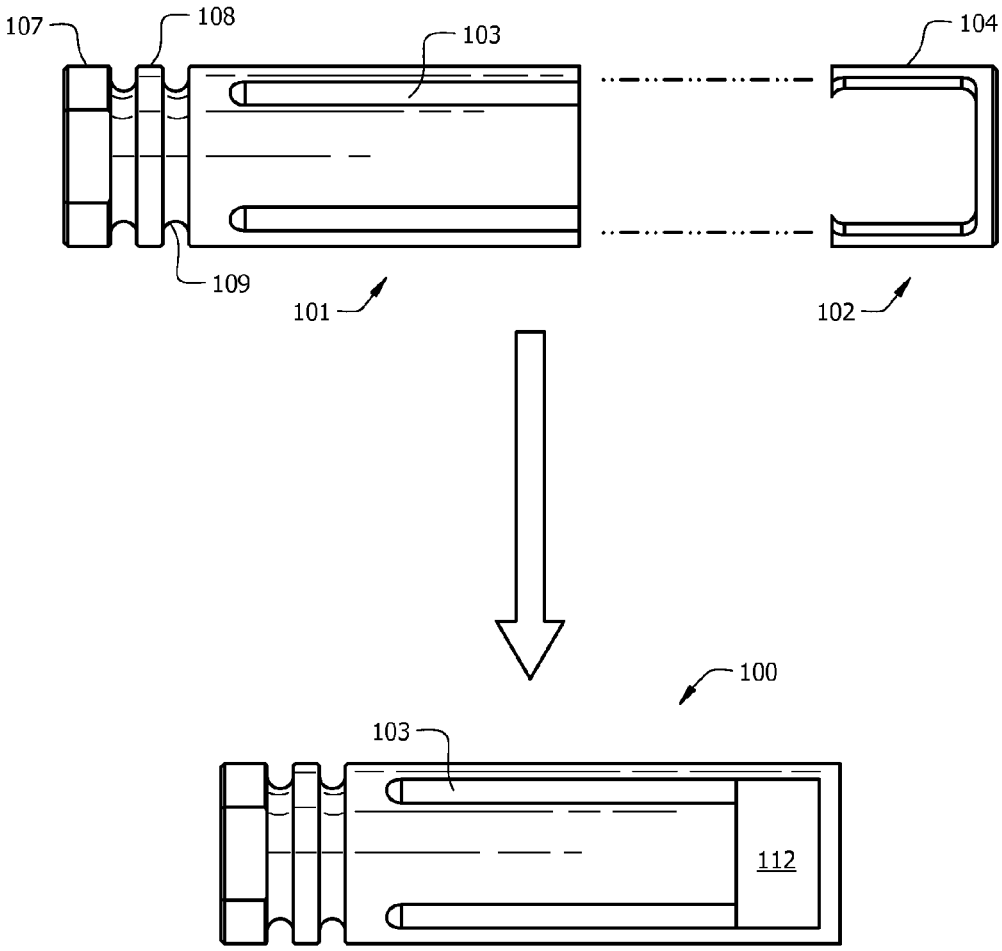
FIG. 2 is a side profile view of an exploded device in one embodiment.

FIG. 1 is a perspective view of an exploded device in one embodiment. The top part of FIG. 1 shows the exploded view, and the bottom part of FIG. 1 shows the device assembled. FIG. 2 is a side profile view of an exploded device in one embodiment. The top part of FIG. 2 shows the exploded view, and the bottom part of FIG. 2 shows the device assembled. In one embodiment, the device comprises a single, integrally made device. Thus, in one embodiment a single device comprises a muzzle brake and a flash hider, as will be discussed below.

The length and width of the device 100 can vary based on the desired use, including bullet caliber. In one embodiment the length ranges from about 1.75 inches to about 6 inches. In one embodiment the width ranges from about ¾ of an inch to about 2 inches. One skilled in the art would understand that these dimensions are for illustrative purposes and should not be deemed limiting. Larger or smaller calibers can require larger or smaller dimensions. As can be seen, in one embodiment, the flash hider 101 is upstream from a downstream muzzle brake 102. As used herein, upstream refers to a location closer to the barrel of the gun whereas downstream refers to a location further from the barrel.

In one embodiment, the flash hider 101 comprises any slotted flash reducing device. In one embodiment the flash hider 101 comprises a bird cage flash hider which has one or more slots. In other embodiments the flash hider 101 comprises an open prong flash hider which has one or more prongs separated by at least one slot. As depicted in FIG. 1, the flash hider 101 comprises an open prong flash hider comprising four elongated slots 103. Slots 103 refer to an opening in the flash hider 101 which extends to external surface of the flash hider. The slots 103 provide an opening through which gasses can escape the flash hider 101. The slots can comprise virtually any shape. As depicted the slots are elongated linear slots which extend along the length of the flash hider 101. A linear slot is a slot with an approximately linear shape. While one embodiment utilizing four slots 103 has been depicted, this is for illustrative purposes only and should not be deemed limiting. In some embodiments only one slot 103 is utilized whereas in other embodiments more than one slot is used.

The size of the slots 103 can depend on the application. In one embodiment the slots 103 have a thickness as measured on the surface of the flash hider 101 and oriented approximately perpendicular to the length of the flash hider 101 of between about 0.100 inches to about 1 inch, depending upon the caliber size. The slots 103 can have any length, but in one embodiment have a length of between about ¾ inch to about 6 inches. In one embodiment the slot has a length of greater than 60% of the device.

As noted, the flash hider 101 is located upstream from a muzzle brake 102. The muzzle brake 102 can comprise any muzzle brake 102 known in the art. In one embodiment, the muzzle brake 102 comprises an open baffle brake. In one embodiment the muzzle brake 102 comprises ports 112 arranged radially, horizontally, vertically, or linearly with the ports being of virtually any shape including square, oblong, round, square with corner radius, with a vectoring angle of anywhere between 45 degrees in the downstream direction to perpendicular to the muzzle centerline to 45 degrees in the upstream direction.

As depicted in FIG. 1, the muzzle brake 102 comprises two ports 112, with each port separated by a longitudinal body 104. The ports 112 are openings or voids through which gas can exit the muzzle brake 102. The ports 112, as depicted, are offset by 180°, though this should not be deemed limiting.

As depicted, the muzzle brake 102 comprises a longitudinal body 104 which couples to the flash hider 101 and to the muzzle face 106. In one embodiment the longitudinal body 104 comprises a length of between about 0.125 inches and about 1 and ¼ of an inch.

Coupled to the longitudinal body 104 is the muzzle face 106. The muzzle face 106 is oriented approximately perpendicular to the length of the barrel. In one embodiment the muzzle face 106 is approximately planar. The muzzle face 106 further comprises a projectile exit 105 through which the bullet exits the muzzle brake 102. The size of the projectile exit 105 will depend upon the caliber of the bullet.

As can be seen in the figures, in one embodiment the muzzle brake 102 comprises an open sided plate connected to the end of a flash hider 101. In short, the flash hider 101 component comes before the muzzle brake 102 component. In one embodiment, such an arrangement sacrifices brake efficiency, but gives flash suppression priority. In one embodiment, flash suppression takes priority as it is often more important for tactical operators to have detection mitigation through flash reduction or elimination compared to brake efficiency. In one embodiment, the flash hider 101 treats the flash problem first and the muzzle brake 102 reduces recoil thereafter. Thus, the gases are treated to reduce flash before being used to reduce recoil. The brake efficiency, in one embodiment, is reduced because the gases hitting the muzzle face 106 lose velocity compared to if the flash hider 101 was not present.

A muzzle device 100 which employs a specific combination of a flash hider 101 and muzzle brake 102 may or may not include features to accommodate, for example, mounting a silencer, use as grenade launcher, a bayonet mount, and a castellated glass breaking feature on the downstream end of the device. The features can be attached to the muzzle device 100 via any method or device known in the art. As an example, for a barrel launched rifle grenade, the device 100 can be of such a diameter and length as to accommodate the grenade. In one embodiment comprising a bayonet, the bayonet comprises a loop on the bayonet guard which mounts over the device 100 diameter. In one embodiment comprising silencers, the silencer utilizes grooves, threads, interrupted threads, lugs, timing slots, ratcheting gear/notches, and/or a conical feature for sealing, location and retention.

Figure 3A:
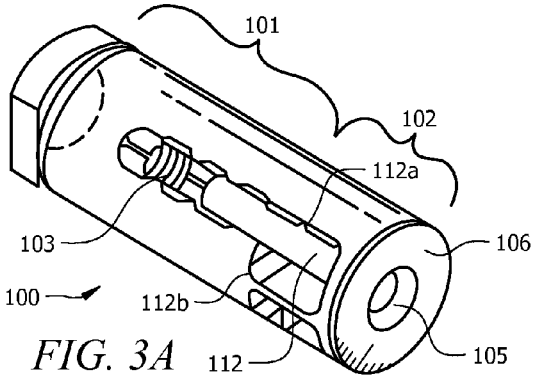
FIG. 3*a* is a perspective view of the device in one embodiment.
Figure 3B:
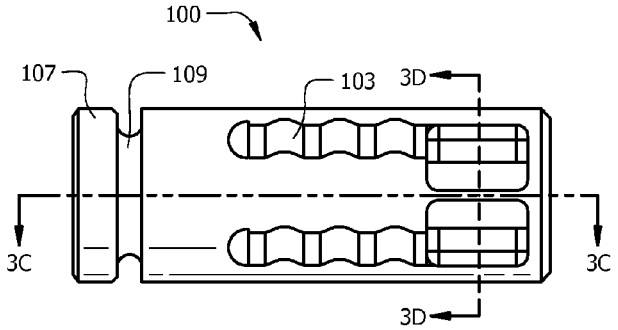
FIG. 3*b* is a side profile view of the device in one embodiment.
Figure 3C:
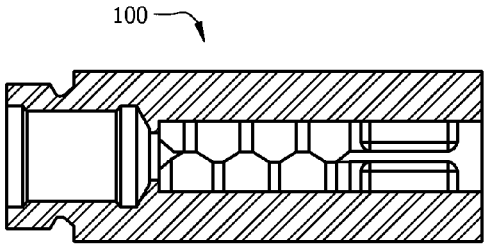
FIG. 3*c* is a side cross-sectional view of the device in one embodiment.
Figure 3D:
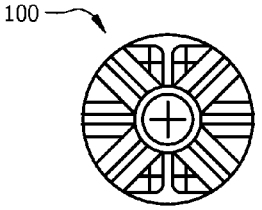
FIG. 3*d* is rear cross-sectional view of the device in one embodiment.

Referring now to FIGS. 3*a*-3*d*. FIG. 3*a* is a perspective view of the device in one embodiment. FIG. 3*b* is a side profile view of the device in one embodiment. FIG. 3*c* is a side cross-sectional view of the device in one embodiment. FIG. 3*d* is rear cross-sectional view of the device in one embodiment. As depicted, the combination flash hider and brake device 100 is comprised of a cylindrical tube with accommodations for attaching to a barrel at the upstream end, and an opening at the downstream end for passing of a projectile. As noted, this device comprises the flash hider portion of the device be at the upstream end and the muzzle brake portion be at the downstream end.

As depicted in FIG. 3A, the flash hider 101 comprises four slots 103. The slots 103 do not have a straight shape; instead, they comprise a non-linear shape. A non-linear shape is any shape which is not straight. As depicted, the slots comprise a non-linear shape which is wavy or sinusoidal shape.

FIG. 3B shows a hider coupler 107. The hider coupler 107 is a device which couples the flash hider device 100 to a weapon. As discussed, the device can be coupled with any method or device known in the art including screwing the flash hider device 100, using bolts, a threaded barrel muzzle, a pinch bolt clamp, screws, etc.

As depicted, adjacent to the hide coupler 107 is a structural element 109. The structural element 109, is any element, such as a rib, beam, or recess, which increases the structural strength of the flash hider device 100. The structural elements 109 allow for cohesion of the muzzle brake 102 to the flash hider 101, and are generally considered, in one embodiment, part of the muzzle brake ports 112. These structural elements 109 give the necessary strength and rigidity to the device to be safe and durable. In one embodiment, they also assist in reducing the harmonic ringing.

As depicted, the flash hider 101 portion of the device 100 is comprised of any number N of slots 103 of any geometry type and opened or ringed attached used to diffuse and/or mix the muzzle exhaust in a way that reduces the flash at the muzzle that would occur if no such device were present.

The muzzle brake 102 portion of the device, as depicted, is comprised as a ported section 112 at the end of the device which reacts and redirects exhaust gasses and reduces recoil impulse. In one embodiment, the muzzle brake 102 is attached to the flash suppressor prongs or ring or combination thereof, and reduces harmonic excitation of the open prong flash hider 101. In one embodiment, open prong flash suppressors with one or more prongs vibrate when excited by muzzle blast or struck by or against an object and may give off an audible harmonic ring. Because of the combination of the flash hider and muzzle brake devices 100, the audible harmonic ringing is reduced to an acceptable or imperceptible level.

Figure 4:
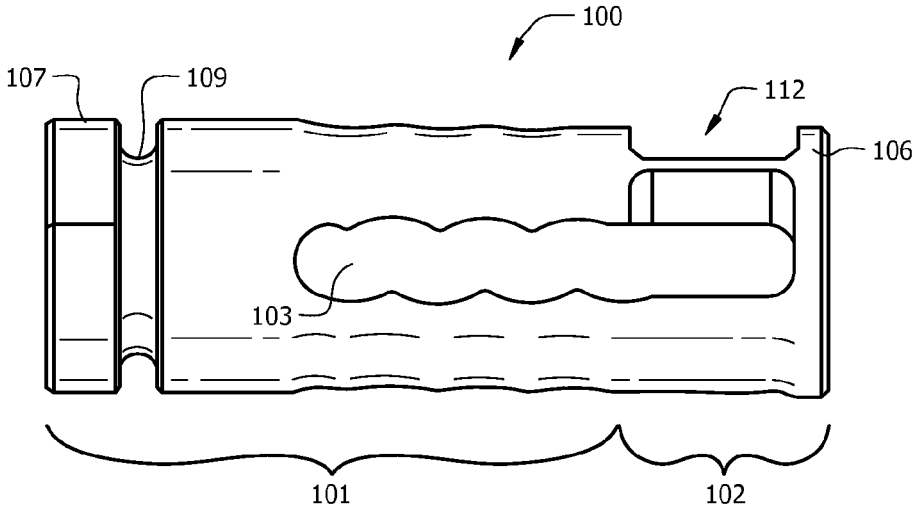
FIG. 4 is a side view of the device in one embodiment.
Figure 5:
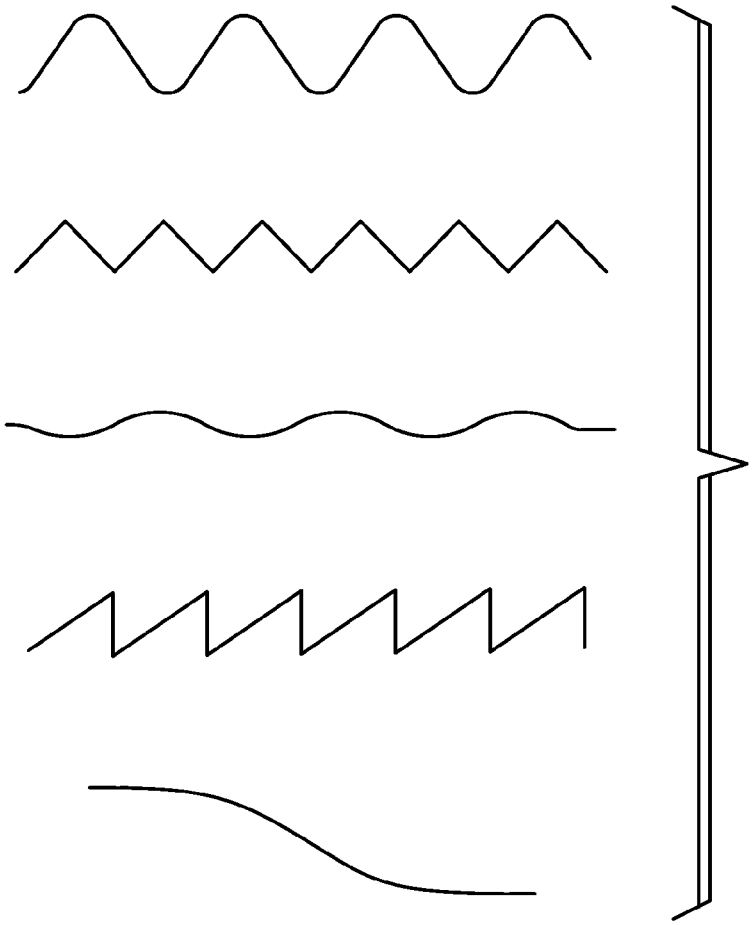
FIG. 5 illustrates various slot geometries in one embodiment.

FIG. 4 is a side view of the device in one embodiment. As depicted in FIG. 4, like in FIG. 3, the device comprises a non-linear slot 103. This is for illustrative purposes only and should not be deemed limiting. Other slot geometry can be utilized, including, but not limited to, wave pattern slots, zigzag slots, S-slots, Sinusoidal slots, or slots with serrated edges. FIG. 5 illustrates various slot geometries in one embodiment. Slots 103 can be arranged radial from the central axis of the device, or offset, with convergent, linear, or divergent exiting pathways. Slots may be manufactured by milling, cutting, broaching etc. These geometric features induce turbulence into the passing muzzle exhaust that cools the muzzle exhaust and results in a reduction of the muzzle exhaust rate of expansion, pressure, and temperature, to a point below the ignition point of un-burnt flammables exiting the barrel. Thus, in one embodiment, the temperature and pressure are reduced and the flash is reduced or eliminated.

The device disclosed herein can be made from a variety of materials, including any ferrous metal, non-ferrous metal, carbon based material, ceramic material, or composite material. Furthermore, in one embodiment, the device can be treated with any surface treatment that may enhance its strength, corrosion resistance, enhance its wear resistance, erosion resistance, fatigue strength, reduce thermal signature, or any treatment used for coloring.

Figure 6:
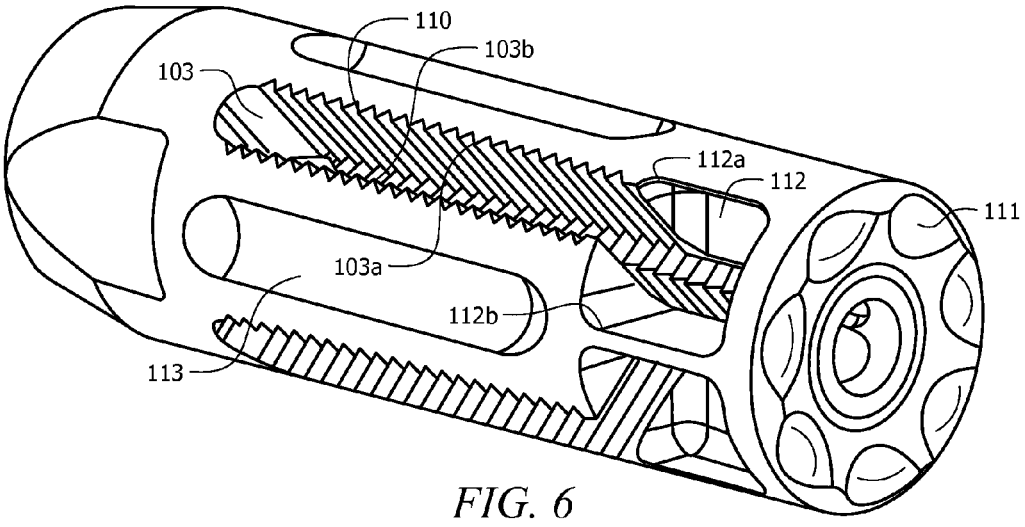
FIG. 6 illustrates a perspective view of a device with a slot comprising serrated edges in one embodiment.

FIG. 6 illustrates a perspective view of a device comprising a slot with serrated edges in one embodiment. The serrated edges 110 further induce turbulence which further decreases temperature and pressure, and which further reduces or eliminates flash. In one embodiment, and as depicted, the serrated edges 110 extend for the entire length of the slot 103. While one embodiment using serrated edges 110 has been described, this is for illustrative purposes only and should not be deemed limiting. Virtually any turbulence inducing item, such as a protrusion of various shapes and sizes can be utilized.

As can be seen, when the gases travel along the slot 103, some of the gases exit along the walls of the slots 103. When exiting along the turbulence inducer, such as the serrated edges 110, small eddies form in the gases. The turbulence inducer breaks the exiting gas into smaller turbulent eddies. Because smaller eddies have greater surface area compared to a single ball of exiting gas, the smaller eddies allows the gases to cool at a much greater rate, reducing or eliminating flash.

As depicted, the slots 103 have a top slot edge 103*a* and a bottom slot edge 103*b*. The ports 112 also have a top port edge 112*a* and a bottom port edge 112*b*. As depicted, upper slot 103 has a top slot edge 103*a* which approximately aligns with the top port edge 112*a*. Because, as depicted, the port 112 is wider than the slot 103, the bottom port edge 112*b* is not aligned with the bottom slot edge 103*b*. Instead, the bottom port edge 112*b* is offset from the bottom slot edge 103*b*.

As depicted, and in one embodiment, the lower slot 103 is a mirror image of the upper slot 103. As seen, the top slot edge 103*a* of the lower slot is not aligned with the top port edge 112*a*. Rather, the bottom slot edge 103*b* is approximately aligned with the bottom port edge 112*b*. Such an arrangement provides a larger concentrated area for the port 112. In other embodiments, rather than being a mirror image, as depicted, the upper and lower slots are identical.

FIG. 6 also depicts a recess 113. A recess 113 is a void or absence of material. The recess 113 is used to reduce the weight of the device.

FIG. 6 also depicts protrusions 111. Protrusions 111 are any element which extend beyond the planar face of the muzzle face 106. There can be multiple protrusions 111 as depicted, or there can be a single protrusion 111. The protrusion 111 can be used for a variety of purposes including, breaking glass, etc.

While the invention has been particularly shown and described with reference to a preferred embodiment, it will be understood by those skilled in the art that various changes in form and detail may be made therein without departing from the spirit and scope of the invention.

ADDITIONAL DESCRIPTION

The following clauses are offered as further description of the disclosed invention.

Clause 1. A device comprising:
- a flash hider;
- a muzzle brake;
- wherein said flash hider is upstream from said muzzle brake.

Clause 2. The device of any proceeding or preceding claim wherein said flash hider comprises at least one slot.

Clause 3. The device of any proceeding or preceding claim wherein said muzzle brake comprises at least one port.

Clause 4. The device of any proceeding or preceding claim wherein said muzzle brake further comprises a longitudinal body adjacent to said at least one port.

Clause 5. The device of any proceeding or preceding claim wherein said muzzle brake comprises a muzzle face and a projectile exit.

Clause 6. The device of any proceeding or preceding claim wherein said muzzle face is approximately planar.

Clause 7. The device of any proceeding or preceding claim wherein said flash hide comprises an open prong flash hider.

Clause 8. The device of any proceeding or preceding claim wherein said at least one slot comprises a linear shape.

Clause 9. The device of any proceeding or preceding claim wherein said at least one slot comprises a non-linear shape.

Clause 10. The device of any proceeding or preceding claim wherein said at least one slot comprises serrated edges.

Clause 11. The device of any proceeding or preceding claim wherein said flash hider comprises at least two slots, and wherein said muzzle brake comprises at least two ports.

Clause 12. The device of any proceeding or preceding claim further comprising a hider coupler located upstream of said flash hider, wherein said hider coupler couples to a weapon.

Clause 13. The device of any proceeding or preceding claim comprising a single integrally made piece.

Clause 14. The device of any proceeding or preceding claim wherein said device does not comprise moving parts.

Clause 15. The device of any proceeding or preceding claim further comprising at least one protrusion located on a muzzle face located on the muzzle brake.

Clause 16. The device of any proceeding or preceding claim comprising a first slot with a top slot edge and a bottom slot edge, and a first port with a top port edge and a bottom port edge.

Clause 17. The device of any proceeding or preceding claim wherein said top slot edge is approximately aligned with said top port edge.

Clause 18. The device of any proceeding or preceding claim further comprising a second slot with a top slot edge and a bottom slot edge, and a second port with a top port edge and a bottom port edge.

Clause 19. The device of any proceeding or preceding claim wherein said top slot edge of said second slot is not aligned with the top port edge of the second port.

What is claimed is:

1. A device comprising:
- a flash hider;
- a muzzle brake;
- wherein said muzzle brake comprises at least one port;
- wherein said device is configured to be coupled to a barrel; wherein said flash hider is upstream from said muzzle brake, and wherein upstream refers to a location closer to the barrel when the device is coupled to a barrel and wherein downstream refers to a location further from the barrel
- and wherein said flash hider comprises an open prong flash hider.

2. The device of claim 1 wherein said flash hider comprises at least one slot.

3. The device of claim 1 wherein said muzzle brake further comprises a longitudinal body adjacent to said at least one port.

4. The device of claim 1 wherein said muzzle brake comprises a muzzle face and a projectile exit.

5. The device of claim 4 wherein said muzzle face is approximately planar.

6. The device of claim 2 wherein said at least one slot comprises a linear shape.

7. The device of claim 2 wherein said at least one slot comprises a non-linear shape.

8. The device of claim 2 wherein said at least one slot comprises serrated edges.

9. The device of claim 1 wherein said flash hider comprises at least two slots, and wherein said muzzle brake comprises at least two ports.

10. The device of claim 1 further comprising a hider coupler located upstream of said flash hider, wherein said hider coupler couples to a weapon.

11. The device of claim 1 comprising a single integrally made piece.

12. The device of claim 11 wherein said device does not comprise moving parts.

13. The device of claim 1 further comprising at least one protrusion located on a muzzle face located on the muzzle brake.

14. The device of claim 1 comprising a first slot with a top slot edge and a bottom slot edge, and a first port with a top port edge and a bottom port edge.

15. The device of claim 14 wherein said top slot edge is approximately aligned with said top port edge.

16. The device of claim 14 further comprising a second slot with a top slot edge and a bottom slot edge, and a second port with a top port edge and a bottom port edge.

17. The device of claim 16 wherein said top slot edge of said second slot is not aligned with the top port edge of the second port.

* * * * *